United States Patent [19]

Waters

[11] 4,249,297

[45] Feb. 10, 1981

[54] NAILING TOOL AND METHOD OF NAILING

[76] Inventor: John V. Waters, 37 Bay Pines Rd., Hilton Head Island, S.C. 29928

[21] Appl. No.: 70,764

[22] Filed: Aug. 30, 1979

[51] Int. Cl.[3] ..... B25C 1/02

[52] U.S. Cl. ..... 29/432; 145/30 R; 145/46; 227/147

[58] Field of Search ..... 227/147; 145/46, 30 R; 81/52.3; 29/428, 432

[56] References Cited

U.S. PATENT DOCUMENTS

| | | | |
|---|---|---|---|
| 411,633 | 9/1889 | Balfour | 145/30 R |
| 3,166,757 | 1/1965 | Downs, Jr. | 145/46 |

FOREIGN PATENT DOCUMENTS

| | | | |
|---|---|---|---|
| 22720 | 6/1911 | United Kingdom | 227/147 |

*Primary Examiner*—John McQuade

*Attorney, Agent, or Firm*—Beveridge, DeGrandi, Kline & Lunsford

[57] ABSTRACT

A nailing tool and method for driving nails into structures in an environment in which limited space in line with and behind the nail prevents contacting the nail with a hammer. The tool comprises a metal bar having two mutually perpendicular slots extending axially of the bar from one end such that one of the slots extends transversely of the bar in a spaced relationship to a striking surface comprising one sidewall surface of the bar and the other slot extends perpendicularly from the one slot to a sidewall of the bar that is opposite the striking surface. A nail is supported in the tool with the head in the one slot and the shank supported in the other slot to extend forwardly of the tool perpendicular to its axis. The nail may be driven into material adjacent the enclosed space by placing the slotted end of the tool and nail into the enclosed space in alignment with the material to be penetrated and then bringing a hammer into contact with that portion of the striking surface of the tool that protrudes from the enclosed space.

8 Claims, 5 Drawing Figures

FIG. 1
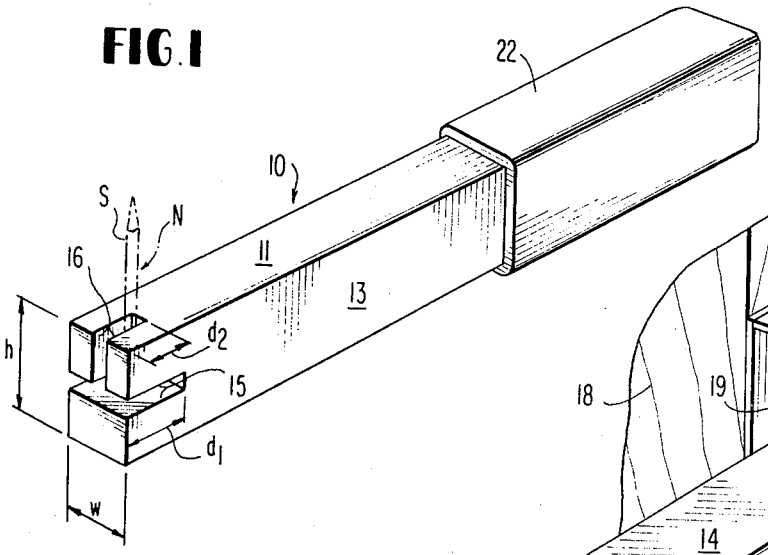
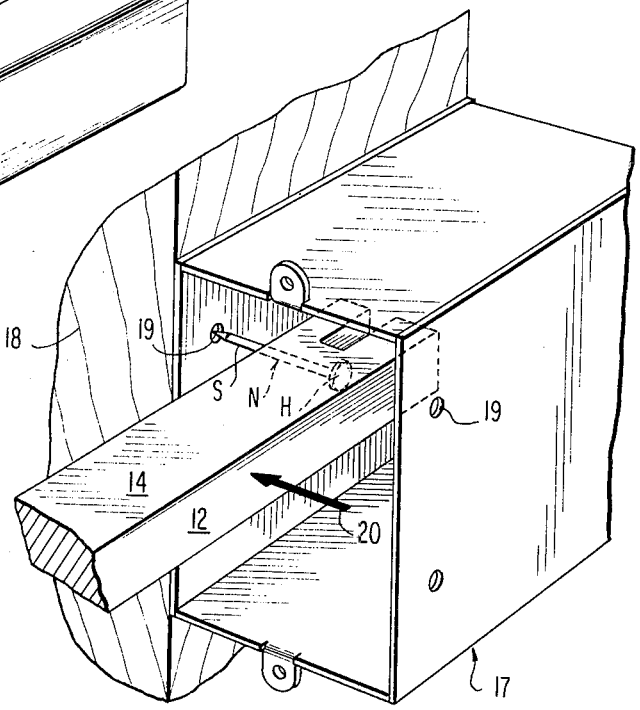
FIG. 2
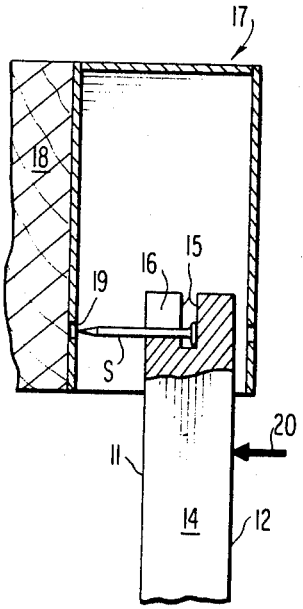
FIG. 3A
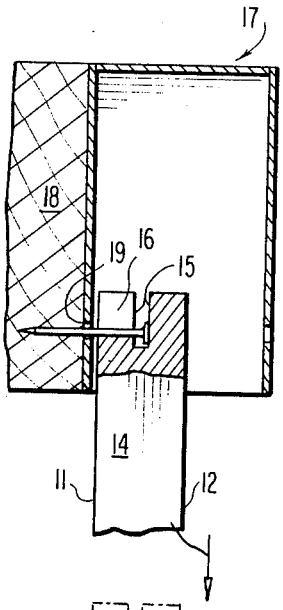
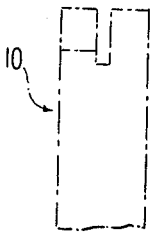
FIG. 3B
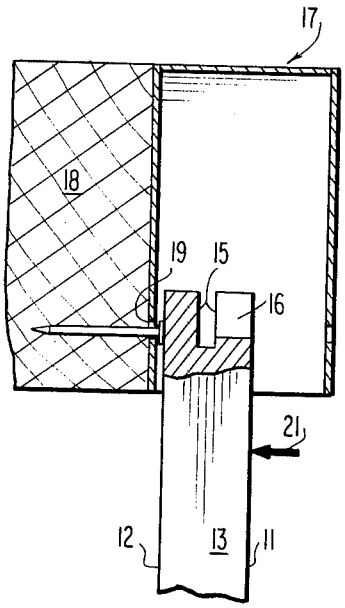
FIG. 3C

NAILING TOOL AND METHOD OF NAILING

BACKGROUND OF THE INVENTION

The present invention relates to a tool and method for holding and driving a nail in an environment in which limited space in line with and behind the nail is such that a hammer cannot be swung into direct contact with the nail.

Situations are frequently encountered in construction work when it is desirable to drive nails in inaccessible locations where there is insufficient space to accommodate the hands and fingers of a person holding the nail and swing a hammer into contact with and drive the nail. A typical example is the situation in which an electrician must fasten one side of an electrical junction box to a wall stud. The space within the interior of the junction box in line with and behind the nail is insufficient to swing a hammer into contact with the head of the nail which initially must be positioned to extend transversely across the interior of the junction box.

A number of devices are available in which the head and shank of the nail are supported in recesses or grooves in one end of an elongated holding device with the shank of the nail projecting longitudinally of and ahead of the holding device which may be struck on the other end to drive the nail into place. Although such a device can be utilized to drive nails into the far end of a recessed space from the open end of which the elongated nail holding device protrudes, such devices cannot be utilized for driving nails in recess spaces where the nail extends transversely across the recess space. Typical devices in which the nail is held in longitudinal alignment with the nail holding device are disclosed in U.S. Pat. Nos. 3,490,677 and 4,029,135. Devices are also known in which the nail is grippingly held at one end of a nail holding device which extends perpendicular to the shank of the nail. Although such devices can be utilized to position and hold the nail in a given location, there must be sufficient space above and in line with the nail to swing a hammer into contact with the nail and drive it home. Typical devices of the latter type are disclosed in U.S. Pat. Nos. 2,802,211 and 3,060,442.

An object of this invention is to provide a device and method by which a nail can be held and driven into place from within inaccessible locations having a very limited space in line with and behind the nail insufficient to swing a hammer into contact with the nail.

Another object of the invention is to provide an economical and rugged tool for driving nails positioned within and transversely across a significant portion of an enclosed space.

A further object of the invention is to provide a device from which a nail is engagingly supported and can be driven into place by a swinging motion of the device.

These and other objects and advantages of the invention will be apparent from the drawings and detailed description of a preferred embodiment of the invention that follow.

SUMMARY OF THE INVENTION

A nail holding and driving tool comprising an elongated bar having two mutually perpendicular slots extending axially of the bar from one end with one of the slots extending transversely of the bar in a spaced and parallel relationship to a longitudinally extending sidewall of the bar adapted to receive nail driving blows from a hammering device and the other slot extending perpendicularly from the first slot to a sidewall of the bar opposite the striking surface. The head of the nail is engaged within the first slot with the shank of the nail supported in the second slot to extend forwardly of the bar perpendicular to its axis. The nail is driven into an object adjoining an enclosed space by placing the slotted end of the tool with an engaged nail into the enclosed space with the nail in alignment with the object to be penetrated and then bringing a hammer into contact with the striking surface that is outside the enclosed space.

DRAWINGS

FIG. 1 is a perspective view of the nail holding and driving tool with a nail inserted therein.

FIG. 2 is a perspective view illustrating the manner in which the tool is utilized to drive nails through one side of an electrical junction box into the adjoining wall of a stud.

FIGS. 3A, 3B and 3C are cross sectional views of the tool and junction box of FIG. 2 illustrating the several positions of the tool and nail in the nail driving process.

DESCRIPTION OF THE INVENTION

The nail driving tool illustrated in FIG. 1 comprises an elongated metal bar 10 rectangular in cross section and having four planar wall surfaces 11, 12, 13 and 14 extending longitudinally between its ends. A slot 15 across the width dimension "w" of the bar between opposing sidewall surfaces 13 and 14 extends from one end of the bar axially along its length in a spaced relationship from and parallel to the primary striking surface face 12 of the bar. Another slot 16 perpendicular to the first slot 15 extends longitudinally of the bar 10 from one end between the first slot 15 and the bar surface 11 opposite the striking surface 12. The depth "$d_1$" of the slot 15 is somewhat greater than the depth "$d_2$" of the slot 16 to accommodate the head H of the nail N of which the shank S is supported in the slot 16 so as to extend forwardly of the face 11 of the bar and perpendicular to the longitudinal axis of the bar 10. The end portion of the bar opposite the slotted end, if desired, can be contained in a wrapping 22 to make the tool easier to hold and which can cushion the shock from hammer blows on the tool striking surfaces.

For reasons that will be obvious from the following description concerning the manner in which the tool is utilized, it is generally preferable that the height dimension "h" of the tool between the side surfaces 11, 12 be greater than the width dimension "w" between the other two side surfaces 13, 14, although this is not necessary. Further, although the bar illustrated in the drawings is rectangular in cross section, since it can be economically produced from rectangular or square bar stock, this does not preclude the bar having other shapes, as long as a striking surface is retained on the side opposite the slot 16 and the side 11 opposite the striking surface also is configured to receive the blows of the hammer. The bar 10 is most conveniently made from steel which is a relatively inexpensive material that will withstand the hammering stresses and can be readily machined to cut the slots in the end of the bar. However, other materials could be utilized if they have the necessary physical qualities. Although it would increase the cost of the tool to some extent, the lower gripping portion of the bar indicated to be covered by the material 22, could be contoured so as to be more readily grasped by the hand and fingers of the user.

A typical utilitarian use of the tool is illustrated in FIGS. 2 and 3A–3C for attaching an electrical junction box 17 to one side of a stud 18 in the wall of a house. As can be readily seen, there is insufficient room within the interior of the junction box to swing a hammer and drive nails through the holes 19 in the side of the junction box into the adjacent stud. The head H of a nail N is placed within the slot 15 with the shank S supported in the slot 16 and extending perpendicular to the longitudinal axis of the bar 10 and the bar is inserted into the interior of the junction box 17 in the manner illustrated in FIGS. 2 and 3A with the nail in alignment with a hole 19 in the side of the junction box that is held in place along one side of the stud 18. An area of the striking surface 12 of the bar immediately outside the junction box 17 is then repeatedly struck with a hammer, as indicated by the heavy arrows 20 in FIGS. 2 and 3A, until the nail is driven sufficiently far into the stud 18 that the surface 11 of the bar is immediately adjacent the interior of the junction box 17 as indicated in FIG. 3B. The bar 10 is then withdrawn along its longitudinal axis to disengage the nail from the slots and remove the bar from within the junction box as indicated in the dashed outline of the tool in FIG. 3B. The tool is then turned to reverse the position of its sides and then reinserted into the interior of the junction box with the striking surface 12 in contact with the head of the partially driven nail. By striking the surface 11 of the bar immediately outside the junction box in the general area indicated by the heavy arrow 21 the nail is then completely driven in the stud in the manner illustrated in FIG. 3C.

The tool can also be utilized as a hammering device to set nails partially into material. After a nail is engaged in the slots of the tool as explained above, the tool may then be swung toward the surface into which the nail is to be set in a direction that the pointed shank end of the nail impacts at the desired location. The tool can then be disengaged from the nail which is partially driven into the material. Although useful, this is not the intended primary purpose of the tool.

It should be understood that the foregoing disclosure relates only to one preferred embodiment of the invention and that numerous modifications and alterations may be made therein without departing from the spirit and scope of the invention as set forth in the appended claims.

I claim:

1. A nailing tool comprising an elongated bar having two mutually perpendicular slots extending axially of the bar from one end, one of said slots extending transversely of the bar in a spaced relationship to a striking surface extending longitudinally of one side surface of the bar a substantial distance beyond the depth of said one slot, said striking surface being adapted to receive blows from hammering means, the other of said slots extending perpendicular to and from said one slot to a longitudinally extending side surface of said bar opposite said striking surface, the depth of said one slot being greater than said other slot.

2. The tool of claim 1 wherein said striking surface is planar and is parallel to the sidewall of said one slot nearest said striking surface.

3. The tool of claim 2 wherein both said striking surface and said opposite side surface are planar surfaces.

4. The tool of claim 3 wherein said bar is a steel bar.

5. The tool of claim 4 wherein said bar is rectangular in cross section with four planar side surfaces, the distance between said striking surface and said opposite bar side surface being greater than that between the other two opposing side surfaces.

6. The tool of claim 5 wherein the end portion of said bar opposite said one slotted end includes hand grasping means adapted to be grasped in the hand of a person with the bar extending substantially perpendicular to the fingers of the gripping hand.

7. A nailing tool comprising an elongated metal bar of rectangular cross section having two pairs of longitudinally extending sidewalls of which each pair are in a spaced apart parallel arrangement with two mutually perpendicular slots extending axially of the bar from one end, a first one of said two slots extending transversely of the bar between one pair of opposite sidewall surfaces in a spaced and parallel relationship to one sidewall surface of the other of said pairs of sidewall surfaces, a second of said two slots extending in a perpendicular relationship from said first slot to the other sidewall surface of said other of said pairs of said sidewall surfaces, the depth of said first slot extending axially of said bar being greater than the depth of said second slot extending axially of said bar, said first slot being adapted to hold the head of a nail and said second slot being adapted to support the shank of a nail having its head in said first slot, a portion of said one sidewall surface of the other of said sidewall surface pairs beyond said second slot being adapted to receive nail driving blows from hammering means.

8. A method of driving a nail into an object immediately adjacent one side of an enclosed space comprising the steps of engaging the head of the nail in a first slot extending from one end of an elongated bar transversely and axially of said bar in a spaced and parallel relationship to an exterior striking surface extending longitudinally of the bar and adapted to receiving hammering blows with the shank of the nail supported in a second slot extending axially of said bar from said one end perpendicular to said first slot between said first slot and an exterior surface of the bar opposite said striking surface with the shank protruding forwardly of said opposite bar surface perpendicular to the axis of the bar, positioning the tool to place the slotted end portion of said bar and engaged nail within the enclosed space with the nail in alignment with its final driven position and the pointed nail end adjacent the object to be penetrated, and bringing a hammering means into striking contact with that portion of said bar striking surface as lies outside said enclosed space to drive the nail into the object.

* * * * *